United States Patent [19]

Smith et al.

[11] Patent Number: 4,641,761

[45] Date of Patent: Feb. 10, 1987

[54] INCREASED STRENGTH FOR METAL BEVERAGE CLOSURE THROUGH REFORMING

[75] Inventors: Eugene F. Smith, Morrison; Tuan A. Nguyen, Northglenn, both of Colo.

[73] Assignee: Ball Corporation, Muncie, Ind.

[21] Appl. No.: 772,837

[22] Filed: Sep. 5, 1985

Related U.S. Application Data

[63] Continuation of Ser. No. 545,556, Oct. 26, 1983, Pat. No. 4,559,801.

[51] Int. Cl.[4] ..... B65D 8/08

[52] U.S. Cl. ..... 220/66; 431/8

[58] Field of Search ..... 220/66; 413/8, 12; 72/348

[56] References Cited

U.S. PATENT DOCUMENTS

| | | | |
|---|---|---|---|
| 4,031,837 | 6/1977 | Jordan | 413/8 |
| 4,093,102 | 6/1978 | Kraska | 220/66 X |
| 4,109,599 | 8/1978 | Schultz | 413/8 |
| 4,448,322 | 5/1984 | Kraska | 220/66 X |
| 4,559,801 | 12/1985 | Smith et al. | 72/348 |
| 4,571,978 | 2/1986 | Taube et al. | 413/8 X |
| 4,577,774 | 3/1986 | Nguyen | 220/66 |

*Primary Examiner*—Steven M. Pollard

*Attorney, Agent, or Firm*—Gilbert E. Alberding

[57] ABSTRACT

Metal beverage closures of increased strength may be produced by a reform process which requires the initial production of a non-standard shell having a reduced countersink radius and reduced panel height. The shell is reformed, preferably in the conversion process, to industry standard dimensions, with the reduced countersink radius being maintained. To provide adequate material in the curl portion of the closure for seaming, the initial shell is provided with a reduced chuckwall diameter which is then reformed to industry standard dimensions.

8 Claims, 3 Drawing Figures

INCREASED STRENGTH FOR METAL BEVERAGE CLOSURE THROUGH REFORMING

This is a continuation of our co-pending application Ser. No. 545,556 filed on Oct. 26, 1983, now U.S. Pat. No. 4,559,801.

BACKGROUND OF THE INVENTION

1. Field of the Invention

The present invention relates to reformed metal beverage closures and more particularly, to increased strength metal beverage closures within present industry standard dimensional specifications.

2. Description of the Prior Art

The prior art discloses numerous examples of metal closures for use with beverage containers. The majority of such closures includes a substantially planar center panel, a countersink portion around such center panel bounded on the inside by an integral inner panel wall and on the outside by an integral chuckwall, a first curved portion integrally joining said inner panel wall to said center panel, a second curved portion at the bottom of said countersink and integrally joining said chuckwall to said inner panel wall, and a peripheral flange extending radially outward from said chuckwall for attachment of the closure to the beverage container. Such containers also typically have an opening panel located on said planar center panel through which the contents of the container are accessed.

Until recently, the material structural dimensions of such closures were typically formed at a single working station concurrently with punching the closure from a metal blank. Closures are then placed through a multistep conversion process during which the opening panel is provided. Recently, in attempts to increase the strength of such closures, there has been considerable experimentation in providing a subsequent alteration to the material structural dimensions of the closure during the conversion process to provide increased strength. One example of such efforts is set forth in U.S. Pat. No. 4,031,837 which relates to altering standard closures in the conversion process by reforming and thereby reducing the radius of the second curved portion at the bottom of the countersink portion of the closure. As taught therein, the provision of a reduced radius in said second curved portion of a closure results in a significant increase in strength and a substantially perpendicular inner panel wall will add to such strength. Experimentation with the teachings of U.S. Pat. No. 4,031,837 has indicated that when a closure is so reformed, the countersink depth decreases while the panel height increases causing the product to be out of industry standards, which makes the product not interchangeable with other suppliers' product, necessitates new seaming tooling by the customer, and creates tab over problems at low internal pressure. The new seaming tooling required by such closures in them is not useable on standard closures. Another approach was tried by forming a nonstandard shell with standard tooling, then utilizing tooling as taught to reform the shell to standard dimensions in U.S. Pat. No. 4,031,837. Results showed that it is extremely difficult or impossible to obtain the type of constant countersink radius provided to closures initially. That is, the radius tends to begin at the juncture of the chuckwall and the second curved portion at the desired reduced radius and then the radius gradually increases until it is back to standard at the juncture of the second curved portion with the inner panel wall. The inner panel wall will also be deformed after the reform to include two straight portions with an additional radius. Although closures produced in conformance with the teachings of U.S. Pat. No. 4,031,837 show a significant increase in strength, in addition to requiring different tooling by customers, the varying radius and deformed inner panel wall detract from the potential strength realizable from a constant reduced radius and straight inner panel wall with a substantially perpendicular orientation. Attempts to realize this potential by providing a reduced radius in the initial forming step have uniformly been unsuccessful as the severe working which the closure undergoes results in a high incidence of fracture and other defects.

Other efforts at increasing strength during the conversion process include tension doming of the center panel portion and coining the annular segment of the closure which comprises the curved portion attaching the center panel to the inner panel wall for the purpose of work hardening and stiffening this segment, both as taught in U.S. Pat. No. 4,217,843.

The goal of the above-described efforts is to provide a reduced gauge sheet metal closure which has the required strength to resist buckling of the closure at internal pressures of 85 and 90 pounds per square inch respectively for soft drink and beer closures. In addition, it is necessary that the closure exhibit a commensurate rock resistance to standard gauge closures as discussed in U.S. Pat. No. 4,217,843. Briefly, rock resistance is defined as the pressure at which the tab or other opening means located on the center panel will be forced above the rim of the beverage container which then exposes the tab to accidental and inadvertent opening when being transported on conveyors or otherwise. As discussed in U.S. Pat. No. 4,217,843, this is one of the major drawbacks of proposals such as that disclosed in U.S. Pat. No. 4,031,837, which contemplate increasing the depth of the center panel with regard to the lower edge of the outer countersink above present standard dimensions. Although U.S. Pat. No. 4,217,843 improves on the prior art, it does so by increasing panel height which places the tab closer to the rim of the closure.

It should also be appreciated that innovations in the metal beverage container industry are strictly limited in scope as articles produced must be compatible with existing customer handling equipment. Most large purchasers of beverage containers utilize more than a single source of supply, and it is therefore necessary that any innovations be made within the specifications set by the customer. Innovations not meeting this criteria will, at least presently, not be commercially acceptable.

SUMMARY OF THE INVENTION

In accordance with the present invention, a shell with dimensions different to those of a finished end is initially produced at the initial forming station. Unlike the previous efforts in this field, the closure is initially provided with a substantially reduced countersink radius of about 0.02 inches in the initial forming step. The shell is then reformed to produce a closure of industry standard dimensions. This results in the production of a closure with a constant radius and a straight inner panel wall with a substantially perpendicular orientation relative to the center panel. The reforming process is preferably performed in the conversion press.

More particularly, the shell is produced having an increased countersink depth, a reduced panel height, a reduced chuckwall diameter and a reduced radius of the second curved portion at the bottom of the countersink, all relative to industry standard dimensions. The shell is then reformed to produce a closure of industry standard dimensions except the second curved portion's radius remains at its reduced magnitude of approximately 0.02 inches.

A particular advantage of the present invention is that the panel height, that is the distance between the lowest portion of the countersink and the lower peripheral edge of the center panel, remains within the tolerances of industry standard dimensions. As is well appreciated in the art, this dimension is particularly critical with regard to obtaining high rock resistance. As mentioned above, the prior art teaches that by increasing the panel height greater buckle resistance may be achieved. A major drawback of following such teachings is that a necessary corollary is that the tab will be forced above the chime or rim at correspondingly lower pressures due to the decreased dome depth. For example, in U.S. Pat. No. 4,217,843 increased buckle strength is partially achieved by increasing panel height. A rock resistance of 60 psi then results. Tests of the subject invention on 206 closures indicate that industry standard dimensions with regard to panel height and dome depth are substantially maintained, and a buckle resistance in excess of 90 psi and rock resistance in excess of 70 psi is obtained for 206 size ecology ends using a 0.0114 nominal gauge of aluminum alloy 5182-H19.

Accordingly, it is an object of the present invention to provide a method of increasing the buckle resistance and rock pressure of a closure.

It is another object of the present invention to provide a closure of thinner metal stock yet which substantially conforms to standard dimensions, buckle resistance and rock pressure thereby providing metal savings and compatibility with present customer handling equipment.

It is yet another object of the present invention to provide a method of increasing the strength of a standard closure through a single additional working step which is easily instituted in most presently used conversion presses.

It is another object of the present invention to provide a substantially reduced radius of about 0.02 inches in the curved portion at the bottom of the countersink in the initial forming step, which has heretofore, not been possible.

It is a further object of the present invention to produce said second curved portion with a reduced and constant radius which is complemented by a straight inner panel wall with a substantially perpendicular orientation by forming said reduced radius in the initial working step.

DETAILED DESCRIPTION OF THE INVENTION

Figure 1:
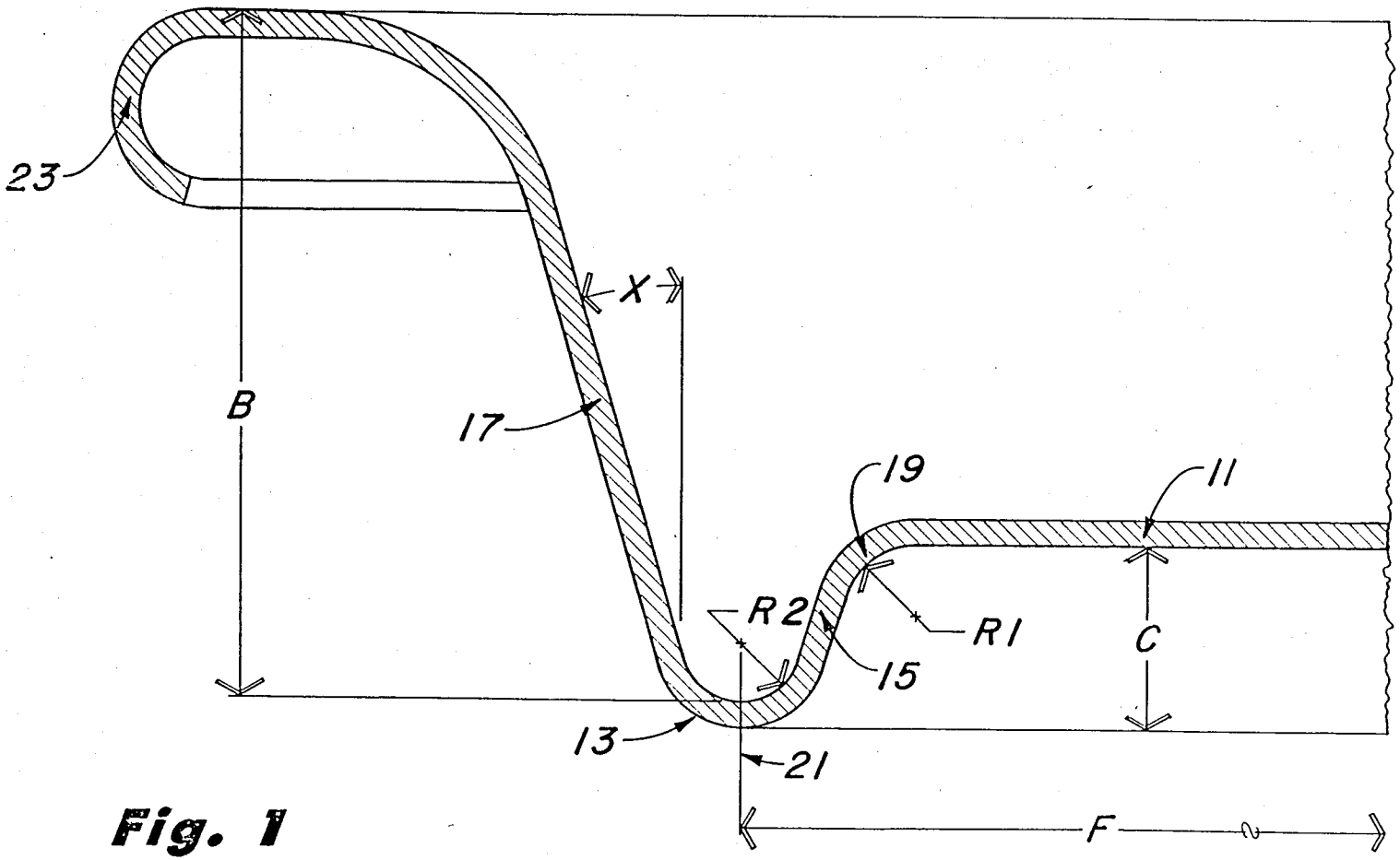
FIG. 1 illustrates a cross-sectional portion of a typical closure produced in accordance with the present invention.

Referring to FIG. 1, a typical shell is illustrated with appropriate reference numerals. The shell includes a substantially planar center panel 11, a countersink portion 13, surrounding said center panel and bounded on the inside by an inner panel wall 15 and on the outside by an integral chuckwall 17, a first curved portion 19 having a first radius R1 and integrally joining said inner panel wall to said substantially planar center panel 11, and a second curved portion 21 having a second radius R2 at the bottom of said countersink portion 13 and integrally joining said panel wall 15 and said chuckwall 17. A peripheral flange 23 extends radially outward from the top of said chuckwall for securing said closure to a beverage container. The radius of the second curved portion 21, referenced R2, will herein be referred to as the countersink radius. Critical dimensions include both R1 and R2, chuckwall angle X, the countersink depth referenced B and panel height referenced C. Also critical is the diameter of the countersink across the center panel which will be defined herein as F. As shown in FIG. 1, the diameter of the countersink is defined as the diameter of the center line bisecting radius R2 of second curved portion 21. The nominal thickness of the shell at the center panel is referenced G although such thickness will vary in the worked portions of the shell.

Figure 2:
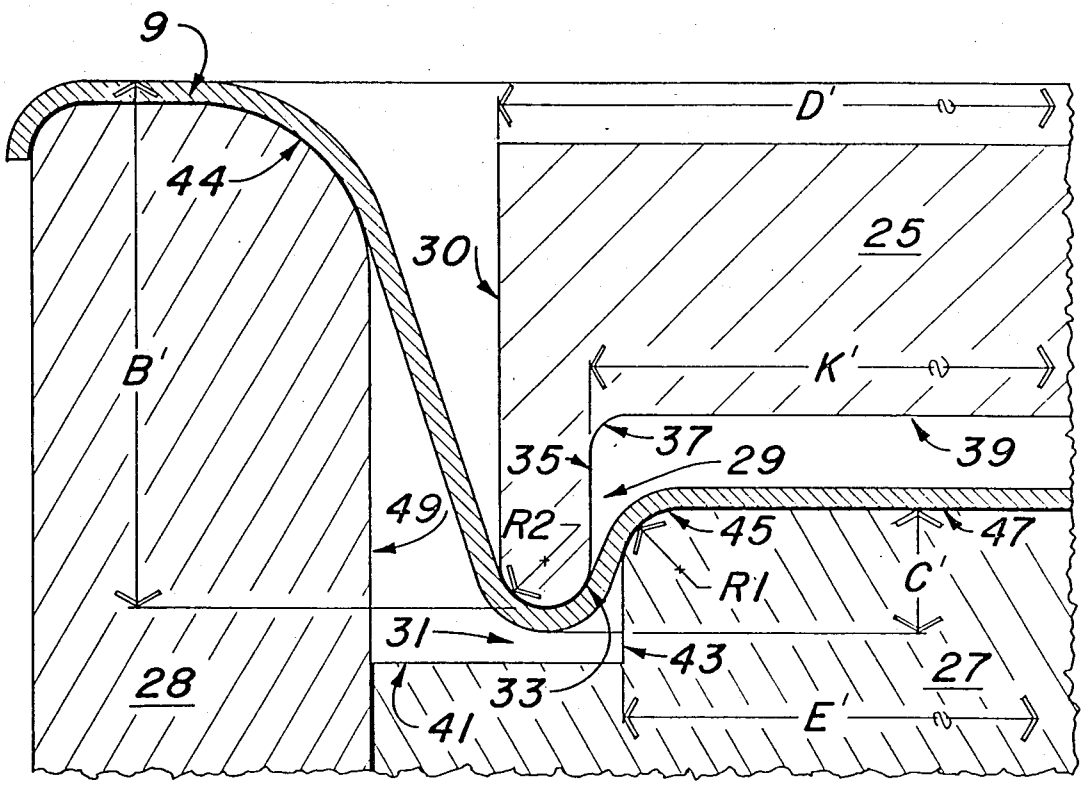
FIG. 2 illustrates the working arrangement for initially forming a shell in accordance with the present invention.

Referring to FIG. 2, a punch core 25, die core 27 and die ring 28 are illustrated in full working position over a shell. The illustrated tooling is typical of that found in a conventional shell press for the initial forming of a shell from planar metal. The punch core has a single convex working surface 33 having a radius of R2 and carried by a protruding nose portion 29. The convex surface terminates in two vertical surfaces, one inward vertical surface 35 and one outward vertical surface 30. The punch core also includes a concave surface 37 and a horizontal surface 39.

The die core 27 includes a convex working surface 45 having a radius of R1 which terminates in a horizontal support surface 47 and a vertical surface 43. The die core also includes a horizontal surface 41. The die ring 28 includes a vertical surface 49 and a generally convex support surface 44. The die core and die ring together define an indented area 31 allowing formation of the countersink portion of the closure by the punch core 25. The inner diameter of the punch core 25 as indicated at vertical surface 35 is referenced K'. The outer diameter of the punch core 25 as indicated at vertical surface 30 is referenced D'.

The inner diameter of the die core as indicated at vertical surface 43 is referenced E'. The punch core 25 and the die core 27 and die ring 28 interact such that the nose portion 29 of the punch core, and more particularly, convex working surface 33, displaces the closure material a distance of C' thereby forming a panel height of approximately C' in depth while the die ring 28 and punch core 25 cooperatively act to displace the curl portion of the closure material a distance of B' thereby forming a countersink depth of approximately B'.

Figure 3:
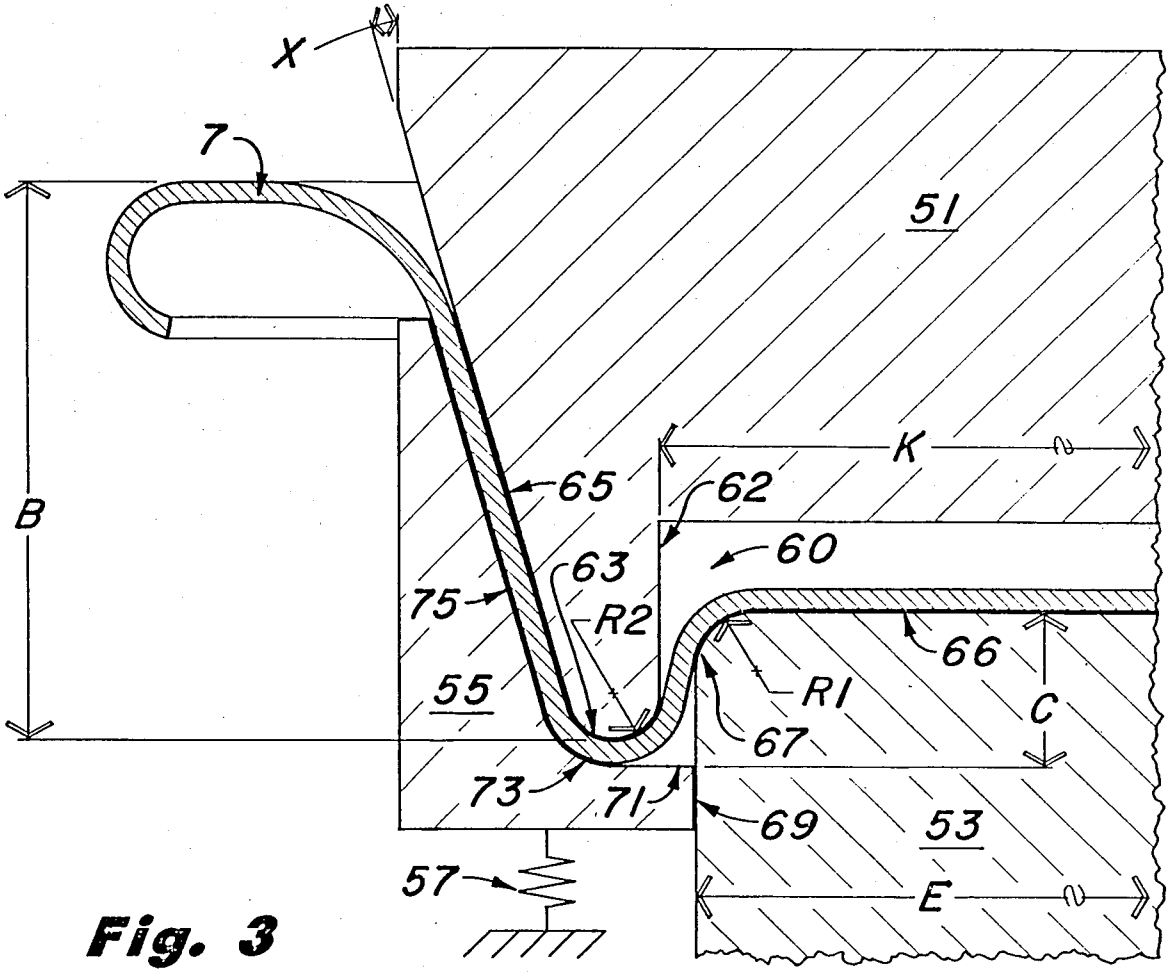
FIG. 3 illustrates the working arrangement for reforming a closure, formed in accordance with the apparatus of FIG. 2, to standard dimensions.

Referring to FIG. 3, the tooling used in the final forming step of the subject invention is illustrated. This tooling includes a punch core 51, a die core 53 and a spring biased outer die ring 55. The punch core 51 includes a protruding nose portion 60 carrying a convex surface 63 with a radius of R2. Convex surface 63 is bounded on the outside by an upwardly and outwardly angled straight surface 65 which makes an angle of X with vertical. Convex surface 63 is bounded on the inside by a vertical surface 62. The inner diameter of the punch core has a magnitude of K.

The die core 53 has a convex forming surface 67 with a radius of R1. Convex surface 67 terminates on the inside in horizontal straight support surface 66 and terminates on the outside in vertical straight surface 69. The die core 53 has an outer diameter with a magnitude of E as defined by straight surface 69.

Die ring 55 includes a spring biasing means 57 which upwardly biases the die ring. The biasing means is preferably a compression spring of the type generally used in such apparatus. The die ring includes a horizontal straight surface 71 which terminates in a concave support surface 73. An upwardly and outwardly angled straight surface 75 is provided from the outer point of concave surface 73. Sraight surface 75 is at the same angle X as straight surface 65 on punch core 51.

In operation, blank sheet metal is initially formed in a shell press having the die and punch components illustrated in FIG. 2. Although the tooling components of FIG. 2 are typical of those used in the industry, certain dimensions are varied from industry standards, as hereinafter set forth, to allow production of a reduced countersink radius in the shell. More particularly, radius R2 of convex forming surface 33 of punch core 25 is reduced from standard dimension as is outer punch core diameter D', and the forming depth C'. The die ring 28 is arranged, however, such that countersink depth B' is greater than industry standards. This will result in the formation of a shell having the general configuration of the closure of FIG. 1, except the curl portion 9 (FIG. 2) will be unfinished. The initially formed shell will also have a reduced countersink radius, a reduced panel height, and an increased countersink depth from a standard shell.

In the preferred embodiment of the present invention the countersink radius R2 has a radius of about 0.02 inches. The initially produced shell is then run through a conventional curling process which curls the outer portion of the shell 9 (FIG. 2) into the conventional configuration illustrated in FIGS. 1 and 3. The shell, which may thereafter be referred to as a closure, is then placed in the tooling illustrated in FIG. 3.

In the apparatus of FIG. 3, the closure is placed into substantial conformance with industry standard specifications except the closure is of increased buckle resistance and rock resistance over conventionally produced closures of similar metal gauge due to the reduced countersink radius and substantially perpendicular inner panel wall relative to the center panel.

Of key importance to the subject invention goal of providing a finished closure of standard dimension in the chuckwall area for accepting existing customers' tooling is the increased countersink depth and reduced punch core 25 outer diameter D' initially provided. Experimentation with various tool and die parameters in the initial shell forming step indicated that the reduced punch core diameter D' and increased countersink depth is necessary to provide additional metal in the chuckwall area prior to the final forming step. In the final forming step, material is drawn from the chuckwall into the countersink radius as the dome depth is increased. Failure to provide additional metal to the chuckwall in the initial forming step would result in a countersink depth reduced from standard dimensions.

As shown in FIG. 3, the convex working surface 63 carried by the protruding nose portion 60 of punch core 51 is moved toward the die core 53 and die ring 55. The closure is initially supported at the countersink region by die ring 55. Convex surface 63 on punch core 51 initially contacts the countersink portion of the closure and pushes said countersink portion and the spring biased die ring 55 toward die core 53 until the center panel of the closure is in contact with support surface 66 on said die core 53. Convex surface 67 on die core 53 then supports the first curved portion of the closure and supporting surface 66 on die core 53 supports the center panel of the closure. Convex surface 63 on punch core 51 continues to work the countersink and chuckwall portion of the closure drawing metal from the chuckwall until panel height is increased to C and countersink depth is decreased to B. The biased die ring 55 provides support to the chuckwall and countersink during the drawing process resulting in the formation of the closure illustrated in FIG. 1 having a panel height of C, a countersink depth of B, a countersink radius of R2, a chuckwall angle of X, a substantially perpendicular inner panel wall relative to the center panel and an increased countersink diameter from FIG. 2.

For example, with regard to 206 ends, industry standards dictate a countersink depth (B) of 0.250 inches, a panel height (C) of about 0.068 inches, a chuckwall angle (X) of approximately 14 degrees and a countersink radius of between 0.02 inches and 0.03 inches. In the preferred embodiment of the subject invention for use with 206 ends the following dimensions of Table I were utilized for the tooling of FIG. 2 and the dimensions of Table II were utilized for the tooling of FIG. 3.

TABLE I

| | |
|---|---|
| D' | 2.145 inches |
| C' | 0.058 inches |
| E' | 2.0390 inches |
| K' | 2.065 inches |
| R1 | 0.030 inches |
| R2 | 0.020 inches |
| B' | 0.264 inches |

TABLE II

| | |
|---|---|
| C | 0.068 inches |
| E | 2.0426 inches |
| K | 2.070 inches |
| R1 | 0.030 inches |
| R2 | 0.020 inches |
| B | 0.250 inches |
| X | 14 degrees |

The shell initially produced with the tooling of FIG. 2 will have a countersink diameter of 2.105 inches and the final product after being acted upon by the tooling of FIG. 3 will have a countersink diameter of 2.110 inches. As is appreciated by those skilled in the art, the exact dimensions of a produced closure are extremely difficult to measure although such closures will conform very closely to the tooling dimensions used to produce them. In fact, the tooling dimensions are commonly used in referring to the various dimensions of the closure as indicated in FIGS. 1 and 3 of the subject application. Therefore, the closure and shell dimensions herein referred to have been determined by reference to the tooling producing the shell or closure although independent measurements of the shells and closures have confirmed this practice.

Several million 206 diameter closures have been produced by tooling of the dimensions specified in Table I and Table II from 5182-H19 aluminum alloy having a nominal guage of 0.0114 inches. Such closures were of the ecology or retained end type and also were coined to a residual of between 0.0065 and 0.0090 inches in accordance with FIG. 7 of Applicant Tuan A. Nguyen's copending U.S. patent application "Improvements in Buckle Resistance for Metal Container Closures", Ser. No. 357,032, filed Mar. 11, 1982, which pending application is incorporated herein by reference. Such closures exhibited a rock resistance of in excess of 70 psi and a buckle resistance well in excess of 90 psi.

Several thousand closures were produced in accordance with the above except having an actual guage of 0.0110 inches. Such closures exhibited a buckle resistance in excess of 90 psi and a rock resistance in excess of 60 psi. Several thousand further closures were produced in accordance with the above except having an actual guage of 0.0108 inches. Such closures exhibited a buckle resistance in excess of 85 psi and a rock resistance in excess of 60 psi making such closures acceptable for use in certain carbonated soft drink beverages.

As indicated above, closures produced in accordance with the subject invention exhibit enhanced buckle and rock resistance over prior art closures having a reduced countersink radius and provide the additional advantage of being substantially compatible with existing customer fill and seal equipment. As would be appreciated by one skilled in the art, a closure of reduced countersink radius of 0.02 inches will require a reduced radius chuck in the customer seal equipment; however, this is a minor modification and once made, such reduced radius chuck will also accommodate closures having the larger conventional radius countersink. Prior art efforts at developing closures with reduced countersink radii resulted in closures having panel heights increased over standard dimensions which resulted in reduced rock resistance and major retooling of the customer seal equipment which made such equipment not compatible with conventionally produced closures. Such prior art efforts have, for the above reasons, met with limited commerical success.

In development of the present invention, considerable experimentation was conducted with prior art teachings, all which utilize an initial countersink radius of 0.03 inches. It was found that some of the problems with regard to rock resistance present in U.S. Pat. No. 4,031,837 and as pointed out in U.S. Pat. No. 4,217,843 could be overcome by initially forming a shell of reduced panel height C with a standard countersink radius of 0.03 inches and then reforming the countersink to a radius of 0.02 inches and raising the panel height C to standard dimension. In fact, closures of standard specification were found producible by using the process and apparatus taught herein with an initial countersink radius of 0.03 inches and a decreased panel height and then reforming the countersink to a radius of 0.02 inches. Such closures, however, uniformly exhibited a nonconstant countersink radius varying from 0.02 on the outermost portion to 0.03 at the inner panel wall 15, and an inner panel wall with an additional radius. Such inner panel wall would have an initial substantially perpendicular portion relative to the center panel, then a radius and an upwardly and inwardly angled straight portion to the first curved portion 19 which joins the panel wall to the center panel. The present invention, by initially forming the countersink to the desired radius of 0.02, yields a uniform countersink radius and a straight inner panel wall with a substantially perpendicular orientation. Empirical testing illustrated that the constant radius countersink and straight inner panel wall of the subject invention yields increased strength.

In accordance with the broadest aspects of the present invention, a method and apparatus are taught for the production of a closure of increased strength through initially forming a nonstandard shell with a reduced countersink radius and panel height then reforming the shell to industry standard dimensions. To provide sufficient material in the chuckwall and peripheral curl for production of a closure of standard dimensions, it is preferable to also initially provide the shell with an increased countersink depth and to utilize a punch core with a reduced outer diameter and upon reforming, place the countersink depth and countersink diameter in specification.

We claim:

1. A sheet metal closure of increased strength, comprising a substantially planar center panel, a countersink portion around said center panel bounded on the inside by an integral inner panel wall and on the outside by an integral chuckwall, said inner panel wall being straight and having a substantially perpendicular orientation relative to the center panel, a first curved portion having a first radius integrally joining said inner panel wall to said center panel, a second curved portion having a second radius at the bottom of said countersink portion to define a countersink radius, and a peripheral flange extending radially outward from said chuckwall, the distance from the upper surface of said flange to the bottom of said countersink radius defining a countersink depth, the distance from the lower surface of said central panel to the bottom surface of said second curved portion defining a panel height, said closure being formed from a shell by the process of initially forming said shell with an increased countersink depth relative to a final, predetermined countersink depth, a reduced panel height relative to the final, predetermined panel height, and a countersink radius of about 0.02 inches and, thereafter, reforming said shell to decrease said countersink depth to said predetermined countersink depth and increase said panel height to said predetermined panel height while maintaining said countersink radius of about 0.02 inches.

2. A sheet metal closure of increased strength, comprising a substantially planar center panel, a countersink portion around said center panel bounded on the inside by an integral inner panel wall and on the outside by an integral chuckwall, said inner panel wall being straight and having a substantially perpendicular orientation relative to the center panel, a first curved portion having a first radius integrally joining said inner panel wall to said center panel, a second curved portion having a second radius at the bottom of said countersink portion to define a countersink radius, and a peripheral flange extending radially outward from said chuckwall, the distance from the upper surface of said flange to the bottom of said countersink radius defining a countersink depth, the distance from the lower surface of said central panel to the bottom surface of said second curved portion defining a panel height, said closure being formed from a shell by the process of initially forming said shell with an increased countersink depth relative to a final countersink depth, a reduced panel height of about 85% of the final panel height, and a countersink radius of about 0.02 inches and, thereafter, reforming said shell to decrease said countersink depth to the final countersink depth and increase said panel height to the final panel height while maintaining said countersink radius of about 0.02 inches.

3. A sheet metal closure as recited in claim 2 wherein the process of initially forming the shell includes providing a countersink depth of about 106% of said final countersink depth and providing in the same step a reduced countersink diameter, and said reforming step includes decreasing said countersink depth and increasing the diameter of the countersink portion whereby sufficient metal will be provided in the peripheral flange for seaming the closure to a beverage container.

4. A sheet metal closure as recited in claim 3 wherein the diameter of the countersink portion in the initial forming step is about 2.105 inches and is increased in the reforming step to about 2.110 inches.

5. A sheet metal closure as recited in claim 2 wherein said predetermined countersink depth is about 0.25 inches.

6. A sheet metal closure as recited in claim 2 wherein said predetermined panel height is about 0.068 inches.

7. A sheet metal closure as recited in claim 2 wherein the thickness of the sheet metal closure has a nominal gauge of about 0.0114 inches or less.

8. A sheet metal closure as recited in claim 2 wherein the thickness of the sheet metal closure has a nominal gauge of about 0.011 or less.

* * * * *